US007767898B2

(12) United States Patent
Nakayama et al.

(10) Patent No.: US 7,767,898 B2
(45) Date of Patent: Aug. 3, 2010

(54) DISPLAY EQUIPMENT AND DISPLAY PROGRAM FOR ELECTRONIC MUSICAL INSTRUMENTS

(75) Inventors: Masayuki Nakayama, Hamamatsu (JP); Masakazu Watanabe, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 671 days.

(21) Appl. No.: 11/784,775

(22) Filed: Apr. 6, 2007

(65) Prior Publication Data

US 2008/0210083 A1 Sep. 4, 2008

(30) Foreign Application Priority Data

Apr. 10, 2006 (JP) ..... 2006-107052
May 30, 2006 (JP) ..... 2006-149105

(51) Int. Cl.
*G10H 7/00* (2006.01)

(52) U.S. Cl. ..... 84/612; 84/636

(58) Field of Classification Search ..... 84/612, 84/636

See application file for complete search history.

(56) References Cited

U.S. PATENT DOCUMENTS 6,388,181 B2 * 5/2002 Moe ..... 84/477 R
6,689,946 B2 * 2/2004 Funaki ..... 84/478
7,291,779 B2 * 11/2007 Hasebe ..... 84/477 R
7,361,829 B2 * 4/2008 Uehara ..... 84/746
7,495,165 B2 * 2/2009 Suzuki et al. ..... 84/622
7,525,035 B2 * 4/2009 Katsuta ..... 84/609
7,539,941 B2 * 5/2009 Suzuki et al. ..... 715/716
2004/0055441 A1 * 3/2004 Katsuta ..... 84/470 R
2005/0241462 A1 * 11/2005 Hirano ..... 84/600

FOREIGN PATENT DOCUMENTS

JP 2001-051586 2/2001
JP 2003-177753 6/2003

* cited by examiner

*Primary Examiner*—Jeffrey Donels
(74) *Attorney, Agent, or Firm*—Foley & Lardner LLP

(57) ABSTRACT

A display system for an electronic musical instrument includes an automatic performance information storage device for storing automatic performance information. The display system also includes a display device for displaying formulated musical notation based on the automatic performance information stored by that automatic performance information storage device. A performance tempo-setting device is provided for setting performance tempo. The length of a graphic corresponding to the length of a musical note displayed on said display device is set according to the performance tempo set by the performance tempo setting device. The display system also includes a scroll device that is adapted to scroll at a set speed regardless of the performance tempo.

24 Claims, 14 Drawing Sheets

Automatic Performance Information

| Event | | delta |
|---|---|---|
| Tempo | 80 | 0 |
| Note-on | 60,100 | 96 |
| Note-off | 60, 80 | 0 |
| Note-on | 62, 90 | 96 |
| Note-off | 62, 85 | 0 |
| Note-on | 64, 90 | 96 |
| Note-off | 64, 80 | 0 |
| Note-on | 65, 75 | 96 |
| Note-off | 65, 80 | 0 |
| Tempo | 160 | 96 |
| Note-on | 67, 80 | 0 |
| Note-off | 67, 90 | 96 |
| Note-on | 65, 80 | 0 |
| Note-off | 65, 60 | 96 |
| Note-on | 64, 70 | 0 |
| Note-off | 64, 65 | 96 |
| Note-on | 62, 70 | 0 |
| Note-off | 62, 80 | 96 |
| ⋮ | ⋮ | ⋮ |

FIG. 3

| FIG. 12A | FIG. 12B |
|---|---|

S130
STATE = WAIT_FALL?
NO
YES
S131
WAIT ← WAIT - 1
S132
WAIT ≤ 0?
NO
YES
S133
WAIT ← 0
STATE ← FALL
S134
STATE = FALL?
NO
YES
S135
ANGLE ← ANGLE - DA
S136
ANGLE ≤ 0?
NO
YES
S137
ANGLE ← 0
STATE ← OFF
DA ← 0
S138
DISPLAY THE KEY STATE ACCORDING TO ANGLE
END

DISPLAY EQUIPMENT AND DISPLAY PROGRAM FOR ELECTRONIC MUSICAL INSTRUMENTS

CROSS-REFERENCE TO RELATED PATENT APPLICATIONS

The present disclosure relates to the subject matter disclosed in Japanese patent application No. 2006-107052, filed on Apr. 10, 2006, and in Japanese patent application No. 2006-149105, filed on May 30, 2006, both of which are incorporated herein by reference in their entirety and for all purposes.

BACKGROUND OF THE INVENTION

The present invention relates to display systems and display programs for electronic musical instruments and, in particular embodiments, to display systems and display programs for displaying a piano roll and a keyboard on a display screen, displaying the piano roll according to an automatic performance, and displaying the appearance of keys being depressed according to key press and key release information.

Conventional display systems are known for graphically displaying automatic performance information for carrying out an automatic performance. One method of this graphic display is the simulation and screen display of a so-called piano roll, paper on which automatic performance information is recorded for carrying out an automatic performance.

A piano roll is a roll made of paper in which automatic performance information is perforated, attached to a organ-type music box or player piano. Produced since the middle of the nineteenth century, these rolls have a construction such that they are fed sequentially, the perforated portion is read with air pressure, and hammers and the like are activated accordingly.

Japanese Unexamined Patent Application Publication 2001-51586 discloses a system for displaying musical notes such as on a piano roll as a performance instructing device. This system displays the range of operation of keys from key depression to key release on a scroll bar, while the scroll bar rolls down in accordance with reproduction of a song. The performer is instructed with regard to the timing of key depression and release.

Also, a display system for an electronic musical instrument is conventionally known for displaying a keyboard comprising a plurality of black and white keys on a display screen, and displaying key depressed and key release states based on key depress and key release. information.

Japanese Unexamined Patent Application Publication 2003-177753 discloses a system for storing images of the depressed and released states of each key of a keyboard, and switching between displaying an image showing the depressed state when a key is depressed and an image showing the released state when a key is released.

However, when a performance tempo is set in various typical systems for displaying a conventional piano roll format, the scrolling speed at which the piano roll is displayed is changed according to the value of the set performance tempo, which differs from a real piano roll, causing an unpleasant sensation. In further detail, with a typical real piano roll, the speed at which the roll is fed is fixed, and when the performance tempo differs, the length of the holes corresponding to the musical notes perforated in the piano roll differs for the same musical note lengths, and the intervals between holes corresponding to notes differ.

Furthermore, with a typical player piano system using actual piano roll paper, rewinding and fast forwarding of the roll paper is done at a predetermine speed, not instantaneously. Furthermore, when starting or stopping rewind or fast forward, or when rewinding and fast rewinding, a sound was generated of the machine operating. However, with conventional devices for displaying with a piano roll format, that rewinding is carried out instantaneously and no mechanical sound is generated, which differs from a player piano performing an actual piano roll and can result in a lack of a sense of reality.

Embodiments of the present invention may be devised to provide display systems and display programs for musical instruments capable of realistically simulating a player piano for carrying out an automatic performance by means of a piano roll.

Furthermore, with typical conventional display systems for an electronic musical instrument, the speed of depression of a key and the speed of releasing a key are not simulated. Instead, the switch from the key released state to the key depressed state and conversely from the key depressed state to the key released state tends to occur instantaneously, so the display differs from the movement at a predetermined speed as with an actual keyboard. Consequently, such conventional displays can result in an unpleasant sensation and a lack of a sense of reality.

Accordingly, further embodiments of the present invention provide display systems and display programs for musical instruments wherein the display of the key state changes at a speed corresponding to the key depress speed and key release speed.

SUMMARY OF THE DISCLOSURE

In one aspect of the invention, a display system for an electronic musical instrument includes an automatic performance information storage device that stores automatic performance information, and a display screen for displaying graphics corresponding to musical notes based on the automatic performance information stored in the automatic performance information storage means. A performance tempo setting means sets the performance tempo, and a musical notation length setting means sets the length of the graphic corresponding to the length of a musical note displayed on the display screen in response to the performance tempo set by the performance tempo setting means. A scroll means scrolls at a set speed regardless of the performance tempo. A resulting effect is that the piano roll may be displayed on the display screen equivalently to a real piano roll, and that the display may be carried out without an unpleasant sensation.

Embodiments may include an automatic performance means for sending instructions to a sound source to generate a musical sound according to the performance tempo set by the performance tempo setting means of the display system. A resulting effect is that display of the piano roll may be carried out matching the automatic performance, simulating a player piano.

According to further aspects of the invention, the scroll means scrolls such that a performance location being performed by the automatic performance means is displayed on the display screen of the display system. A resulting effect is that the location on the score being automatically performed can be confirmed on the piano roll.

In another embodiment, the display system is provided with a measure line setting means for displaying a measure line on the display screen of the display device. A resulting effect is that it can be easy to grasp the relationship between the graphic displayed on the piano roll and the musical note.

The display system may be provided with display position setting means for arbitrarily setting a display position of a score displayed on the display screen. The scroll means scrolls the display screen at a speed faster than the set speed, to a display position of the score set by the display position setting means of the display device. A resulting effect is that the appearance of a real piano roll fast forwarding and rewinding may be simulated when fast forwarding and rewinding a piano roll.

A display system according to a further embodiment of the invention may be provided with a sound effect generation means for generating a sound effect when the scrolling means scrolls the display screen at a speed faster than the set speed. A resulting effect is that the appearance of a more realistic piano roll fast forwarding and rewinding may be simulated when fast forwarding or rewinding a piano roll.

In a further embodiment of the display system, the display screen displays a graphic corresponding to a musical note based on the automatic performance information stored in the automatic performance information storage means and a keyboard comprising a plurality of keys, has input means for inputting pitch information for indicating a pitch of a key depressed or released based on the above-mentioned automatic performance information and speed information for indicating an operation speed. The display system may include key depiction means for displaying a position of a key according to pitch information inputted by the input means, where the key position changes at a change speed according to the speed information. Accordingly, a more realistic display of the keyboard key may be achieved.

The display system may be adapted to display a keyboard comprising a plurality of keys and may include input means for inputting pitch information for indicating a pitch of a key depressed or released and speed information for indicating an operation speed. Key depiction means may be provided for displaying a position of a key according to pitch information inputted by the input means, where the key position changes at a change speed according to the speed information. A resulting effect is that the position of a key may be displayed as changing at a speed according to a key depression speed and key release speed and that display may be realistic and natural in appearance.

The display system according to a further embodiment may include key state image storage means for storing an image at the topmost position and an image at the bottommost position of a key stroke, as well as one or more images at one or more positions between the topmost position and the bottommost position. The key depiction means carries out depiction by switching the images stored in the above-mentioned key state image storage means at a time interval according to the speed information. A resulting effect is that the appearance of a key being depressed and released can be displayed faithfully by relatively simple processing.

A display system for an electronic musical instrument according another embodiment of the present invention includes an automatic performance information storage means for storing automatic performance information, automatic performance means for generating information for issuing an instruction to generate or stop a musical sound based on the automatic performance information stored in the automatic performance information storage means, and display means for displaying a key of the keyboard moving based on the automatic performance information, and further comprises input means for inputting pitch information for indicating a pitch of a key depressed or released generated by the above-mentioned automatic performance means and speed information for indicating an operation speed, and key depiction means for displaying a position of a key according to pitch information inputted by the input means changing at a change speed according to the speed information. A resulting effect that the position of a key may be displayed as changing at a speed according to a key depression speed or key release speed in an automatic performance, and display may be carried out with a high degree of realism.

A display system according to the above embodiment may include a key state image storage means for storing an image at the topmost position and an image at the bottommost position of a key stroke, as well as one or more images at a position between the topmost position and the bottommost position. The key depiction means carries out depiction by switching the images stored in the above-mentioned key state image storage means at a time interval according to the speed information. A resulting effect is that the appearance of a key being depressed and released can be displayed faithfully by simple processing.

In one embodiment, the key depiction means depicts a key starting to press down before a timing at which the automatic performance means issues an instruction to a sound source to start sound production. A musical sound may be generated at the time when the key reaches the vicinity of the bottommost position of a stroke, and the key depressing and sound production timing coincide. Consequently, the display may be carried out with a high degree of realism.

In particular embodiments, the slower a key depression speed indicated by the speed information, the earlier the timing is set for depicting the key starting to press down. A resulting effect is that when the key depression speed is slow, the position of the key being displayed and the generated musical sound timing can coincide.

According to a further embodiment of the present invention, a display program is provided for an electronic musical instrument having automatic performance information storage means for storing automatic performance information and a display screen for displaying a graphic corresponding to a musical note based on the automatic performance information stored in the automatic performance information storage means. The display program is operated by processing electronics to provide: performance tempo setting for setting a performance tempo, note length setting for setting the length of a graphic corresponding to the length of a note displayed on the above-mentioned display screen according to the performance tempo set by the performance tempo setting step, and scrolling for scrolling the above-mentioned display screen at a set speed regardless of the performance tempo. A resulting effect is that the piano roll displayed on the display screen may be displayed equivalently to a real piano roll, and the display may be carried out without an unpleasant sensation.

In one embodiment, the display program includes an automatic performance step that sends instructions to the sound generator to generate musical sound in accordance with the stored performance tempo set by the performance tempo setting step. A resulting effect is that display of a piano roll is carried out matching the automatic performance and a player piano may be simulated.

In one embodiment, the scroll step scrolls such that a performance location being performed by the automatic performance step is displayed on the display screen. A resulting effect is that the location on the score being automatically performed can be confirmed on the piano roll.

The display program may include a step of measure line setting for displaying a measure line on the display screen. A resulting effect is that it may be easy to grasp the relationship between the graphic displayed on the piano roll and the musical note.

The display program may include a step of display position setting for arbitrarily setting a display position of a score displayed on the display screen, wherein the scrolling step scrolls the display screen at a speed faster than the set speed to a display position of the score set by the display position setting means. A resulting effect is that the appearance of a real piano roll fast forwarding and rewinding may be simulated when fast forwarding and rewinding a piano roll.

In one embodiment of a display program, the display screen is controlled to display graphics corresponding to a musical note based on the automatic performance information stored in the automatic performance information storage means and to display a keyboard comprising a plurality of keys, and the program comprises the steps of: inputting for inputting pitch information for indicating a pitch of a key depressed or released based on the above-mentioned automatic performance information and speed information for indicating an operation speed, and key depicting for displaying a position of a key according to pitch information inputted by the inputting step, where the key position changes at a change speed according to the speed information. A resulting effect is that a piano roll may be displayed suitably and a key of the keyboard may be displayed according to the depress and release speed. Consequently, a relatively realistic display may be achieved.

In a particular embodiment, the display program displays a keyboard comprising a plurality of keys, and the display program comprises the steps of: inputting for inputting pitch information for indicating a pitch of a key depressed or released and speed information for indicating an operation speed, and key depicting for displaying a position of a key according to pitch information inputted by the input step changing at a change speed according to the speed information. A resulting effect is that the position of a key may be displayed as changing at a speed according to a key depression speed and key release speed and that display may be carried out with a high degree of realism.

The key depiction step may carry out depiction by switching the images stored by the key state image storage means for storing an image at the topmost position and an image at the bottommost position of a key stroke, as well as one or more images at one or more positions between the topmost position and the bottommost position at a time interval corresponding to the speed information. A resulting effect is that the appearance of a key being depressed and released can be displayed faithfully by simple processing.

According to a further embodiment of the invention, a display program for an electronic musical instrument operates with automatic performance information storage means for storing automatic performance information, automatic performance means for generating information for issuing an instruction to generate or stop a musical sound based on the automatic performance information stored in the automatic performance information storage means, and display means for displaying a key of the keyboard moving based on the automatic performance information, wherein the display program comprises the steps of: inputting for inputting pitch information for indicating a pitch of a key depressed or released generated by the above-mentioned automatic performance means and speed information for indicating an operation speed, and key depicting for displaying a position of a key according to pitch information inputted by the input step changing at a change speed according to the speed information. A resulting effect is that the position of a key may be displayed as changing at a speed according to a key depression speed or key release speed in an automatic performance, and display may be carried out with a high degree of realism.

According to a further aspect of the above display program embodiment, the key depiction step may display by switching the images stored by the key state image storage means for storing an image at the topmost position and an image at the bottommost position of a key stroke, as well as one or more images at one or more positions between the topmost position and the bottommost position at a time interval corresponding to the speed information. A resulting effect is that the appearance of a key being depressed and released can be displayed faithfully by simple processing.

According to yet a further aspect of the above display program embodiment, the key depiction step depicts a key starting to press down before a timing at which the automatic performance means issues an instruction to a sound source to start sound production. A musical sound may be generated at the time when the key reaches the vicinity of the bottommost position of a stroke, and the key depressing and sound production timing coincide. Consequently, the display may be carried out with a high degree of realism.

In accordance with a further aspect of the above display program embodiment, the slower a key depression speed indicated by the speed information, the earlier the timing is set for depicting the key starting to press down. A resulting effect is that when the key depression speed is slow, the position of the key being displayed and the generated musical sound timing coincide.

BRIEF DESCRIPTION OF THE DRAWINGS

FIG. 3 illustrates a table of automatic performance information according to an embodiment of the invention.

FIG. 4(*b*) illustrates an embodiment of a diagram that displays the song beginning on the piano roll of FIG. 4(*a*).

DETAILED DESCRIPTION

Figure 1:
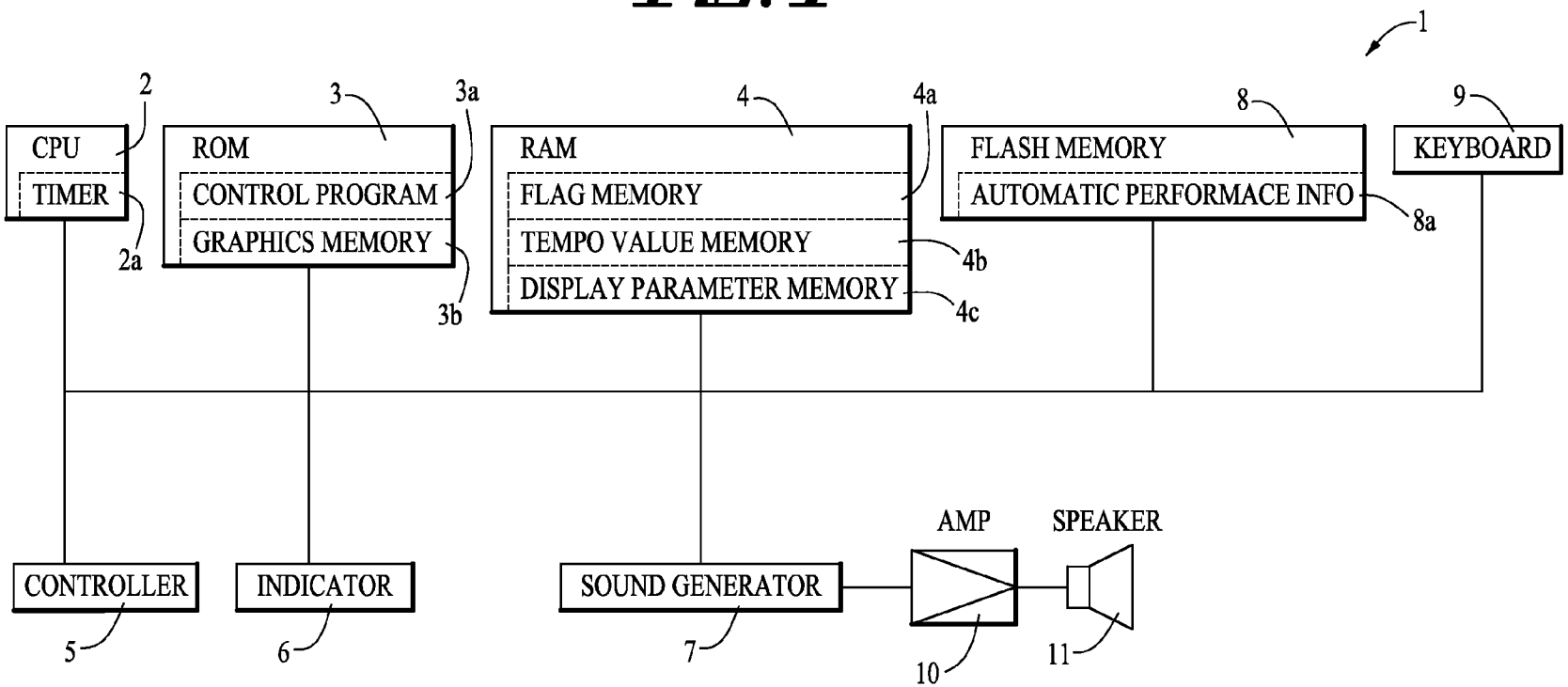
FIG. 1 is a block diagram that illustrates an electronic configuration of an electronic musical instrument according to an embodiment of the invention.

Following are explanations of certain embodiments of the invention with reference to the attached figures. FIG. 1 is a block diagram that displays an electrical configuration of an electronic musical instrument 1 according to one embodiment of the invention.

The electronic musical instrument 1 is configured with a central processing unit (CPU) 2, a read-only memory (ROM) 3, a random access memory (RAM) 4, a controller 5, an display 6, a sound generator 7, a flash memory 8, a keyboard 9, an amplifier (amp) 10, and a speaker 11.

The CPU 2 is a processor for carrying out processing such as automatic performance and a piano roll display according to a control program stored in the ROM 3. The CPU 2 is provided with a timer 2*a* for timing with a predetermined time unit.

The ROM 3 comprises a control program memory 3*a* for storing control programs executed by the CPU 2, and an image memory 3*b* for storing image data used when executing depiction of an image in the control program. A program for carrying out an automatic performance, a program for displaying a piano roll and a keyboard, and the like may be stored as control programs.

The RAM 4 is a rewritable memory having a working area for temporarily storing various data when executing the control program stored in the ROM 3, and a display data storage area for storing display data when displaying piano roll graphics and keyboard graphics on the display 6. The RAM 4 comprises a flag memory 4*a* for storing flags for indicating whether an automatic performance is being carried out, whether fast forwarding is being carried out, and whether rewinding is being carried out; a flag F for providing a delay time between display of the keyboard and control of the sound source when starting an automatic performance; and a flag map[n] for indicating the state of each key of the keyboard 9; a tempo value memory 4*b* for storing the value of the tempo currently set; as well as a display parameter memory 4*c* for storing variables and the like for when depicting piano roll graphics and keyboard graphics.

A first in, first out (FIFO) configuration may be used for successively storing events stored as automatic performance information and displaying keyboard movement.

The controller 5 is for regulating switches for issuing instructions such as to start and stop an automatic performance, volume when an automatic performance is carried out, and the like.

The display 6 may comprise, for example, but not limited to, an LCD (liquid crystal display) capable of displaying the piano roll graphics and keyboard graphics. An example display mode is described below with reference to FIG. 2.

The sound generator 7 forms a musical sound with a pitch, a volume, and a tone specified by the CPU 2, reading the waveform of a musical instrument (such as a piano, a flute, a violin, or the like) or of a sound effect stored for simulating the rotating sound of a roller when fast forwarding or rewinding a real piano roll or the mechanical sound generated when the roll paper is wound at fast speed or when winding starts or ends. The musical sounds formed by the sound generator 7 are amplified by the amplifier 10 and released by the speaker 11.

The flash memory 8 is a rewritable, nonvolatile memory fitted so as to be freely detachable in a slot (not illustrated) provided in the electronic musical instrument 1, and stores automatic performance information 8*a* for carrying out an automatic performance. The automatic performance information 8*a* comprises a song title, composer and other information corresponding to the song, is constructed from performance information for performing following the passage of time, and is described below with reference to FIG. 3.

The keyboard 9 is for a musical instrument constructed from a plurality of black and white keys, specifies the pitch of a musical sound to be generated, and issues an instruction to start sound production in response to key depressing as well as issuing an instruction to stop the sound production in response to key releasing. Performance sounds from the sound generator 7 are generated by performing the keyboard 9, and by storing that performance, automatic performance information can be formed.

Figure 2:
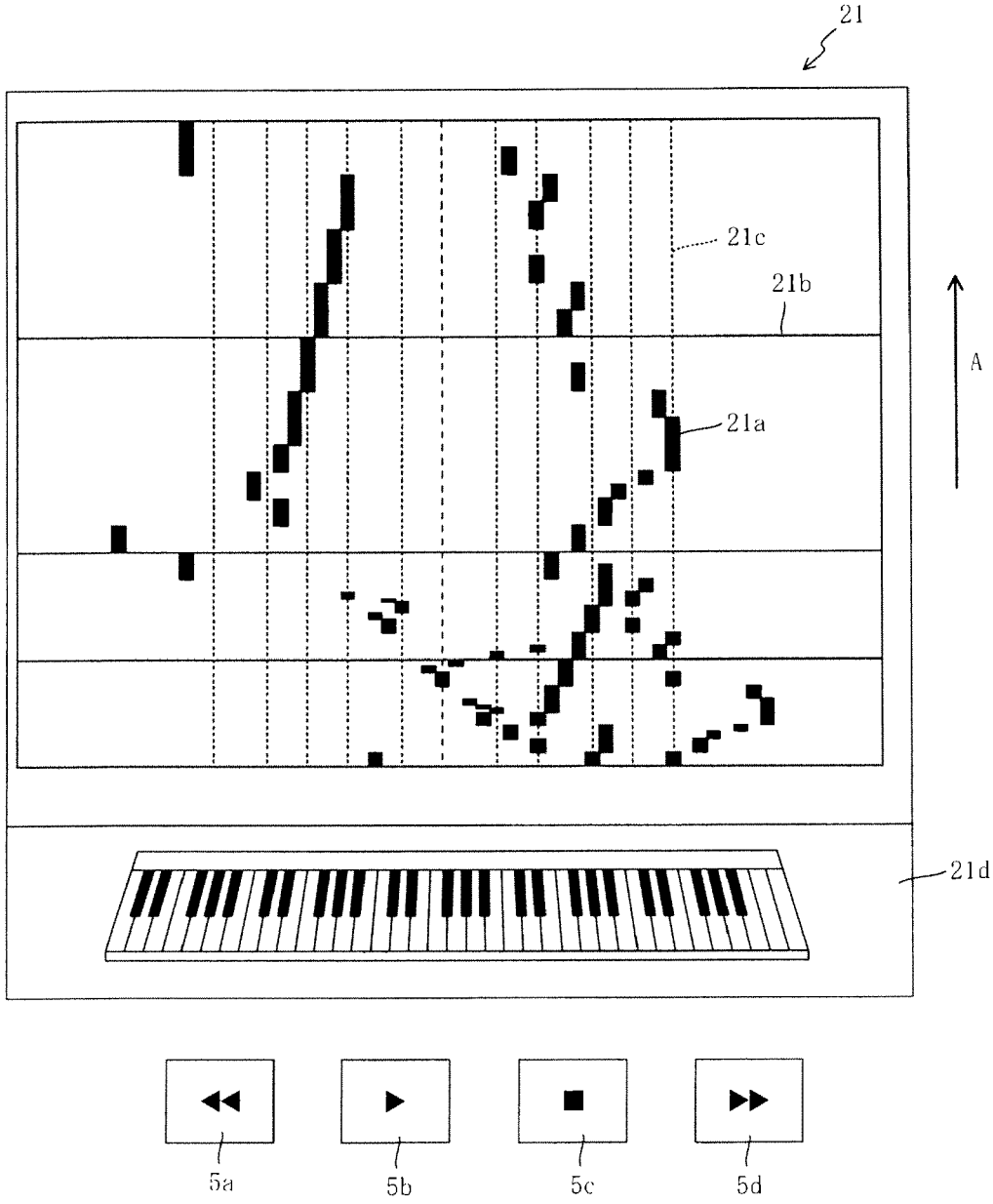
FIG. 2 is a panel diagram of an operation panel of an electronic musical instrument having an operator and a display screen for displaying piano roll graphics and a keyboard.

Next, a display screen 21 displayed on the display 6 and the controller controlled when carrying out an automatic performance are described with reference to FIG. 2. FIG. 2 illustrates an operating panel arrangement of the display 6 and four switches of the electronic musical instrument 1.

Piano roll graphics are displayed at the upper section of the display screen 21 and keyboard graphics 21*d* at the lower section. In the piano roll graphics, the time during which a key is depressed is displayed with a black, rectangular musical note line 21*a*, and the pitch is represented in the horizontal direction simulating the arrangement of the keys of the keyboard 9, with the keys displayed having a higher pitch toward the right side.

The vertical direction represents time, with the event of time progressing from top to bottom. Consequently, the piano roll graphic is scrolled from bottom to top (in the direction of an arrow A) accompanying the progression of the performance.

The rectangular musical note line 21*a* displayed as long and black in the vertical direction in the display screen 21 represents a keyboard key being depressed. Dashed lines 21*c* drawn vertically in the display screen 21 represents the position of five staff lines, and in the drawing, the somewhat thicker dashed line in the center represents the pitch of middle C, with the five lines to the right corresponding to the high note section (representing each pitch F, D, B, G, and E in order from the dotted line at the right), and the five lines to the left corresponding to the low note section (representing each pitch A, F, D, B, and G in order from the dotted light at left of the somewhat thick dashed line at the center).

Also in the display screen 21, the solid lines drawn horizontally represent measure lines, and in this display screen, the intervals of the upper measure lines are depicted as wide, and the intervals of the lower measure lines are depicted as narrow. This means that the tempo in the portion of the upper wide interval is slow and the tempo in the portion of the narrow interval is fast.

The keyboard graphics 21*d* displays the keyboard configured with a plurality of black and white keys in three dimensions. When an automatic performance is carried out, the keyboard graphics 21*d* displays keys depressed corresponding to the pitches of musical sounds generated, and the keys coming to a released state when generation of the musical sound stops. The speed at which the keys move is depicted as changing according to the speed of key depression and release.

Furthermore, the timing of musical sound generation is such that sound is generated when a key reaches a predetermined depth of depression after key depression begins, and, thus, the musical sound generated is delayed by a time interval according to the key depression speed after the time when depiction of key movement begins. Similarly, when a key is released, generation of the musical sound stops, but the stop of the sound is delayed by the time interval according to the key release speed after the time when depiction of key movement begins.

In the bottom half of the display 6, there are four switches that activate the automatic performance. In order from the left, the switches are a rewind switch 5*a*, a play switch 5*b*, a stop switch 5*c* and a fast-forward switch 5*d*. When the rewind switch 5*a* is activated, the performance returns from the current performance position toward the beginning of the song at a high speed. When the play switch 5*b* is activated, the performance starts from the current position. When the stop switch 5*c* is activated, the performance is stopped. When the fast-forward switch 5*d* is activated, the performance moves forward from the current performance position toward the end of the song at a high speed.

When an automatic performance is carried out, the performance is carried out according to the automatic performance information, and the piano roll graphic corresponding to that automatic performance information is displayed in the display 6. When an instruction is issued to rewind or fast forward, the performance is not carried out based on the automatic performance information, a sound simulating the mechanical sound of piano roll paper being wound is generated, and the piano roll graphic is scrolled at high speed (refer to FIG. 4(*a*)). When the winding begins, a sound for simulating the mechanical sound of starting a winding is formed by the sound generator 7, and when the winding ends, a sound for simulating the mechanical sound of stopping the winding is formed by the sound generator 7.

Next, the automatic performance information is described with reference to FIG. 3. FIG. 3 shows a table for indicating the automatic performance information. The automatic performance information in this embodiment comprises the event type and the time (delta) until the next event as a set of data arranged or stored successively, according to the passage of time.

In the data listed in the first row of the table shown in FIG. 3, the type of event is listed as a tempo with a value of 80 (beats/minute), and the time until the next event is listed as 0 (the unit is ticks). A tick is the value found by dividing one beat by a predetermined number, and here, a tick is the value found by dividing 1 beat by 96. The read tempo value is stored in the tempo value memory 4*b* provided in the RAM 4.

In the data listed in the next row, the event type is note on, and the time until the next event is 96 ticks. Here, note on and note off are data for indicating that the keyboard is depressed and released, respectively, with MIDI specifications, and the note number indicating the pitch and the velocity value (taking a value from 1 to 127) indicating the depress speed or release speed are shown delimited by commas in the second column of FIG. 3. The automatic performance information is similarly constructed below by the time from one event until the next.

Figure 4A:
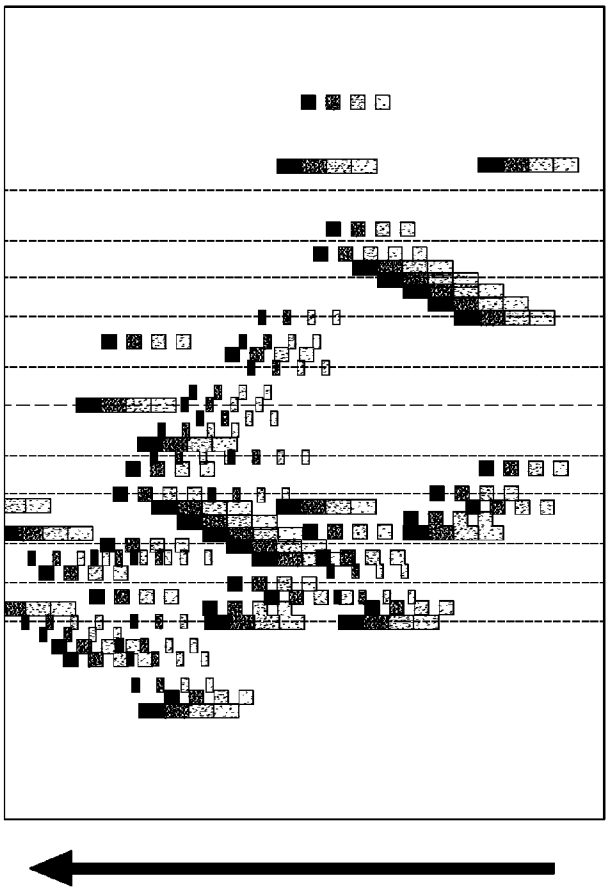
FIG. 4(*a*) illustrates an embodiment of piano roll graphics when rewinding.
Figure 4B:
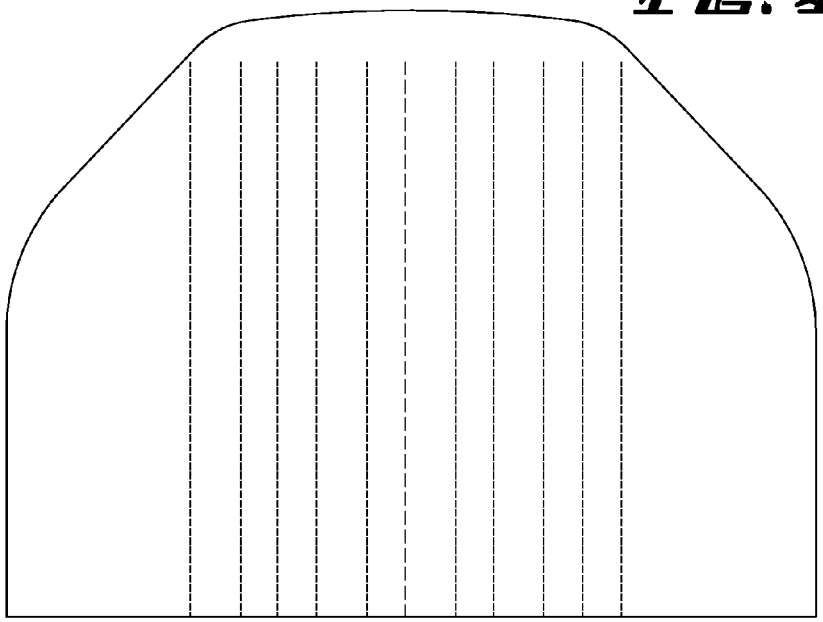

Next, the piano roll graphics displayed on the display 6 when an automatic performance is not being carried out is described with reference to FIG. 4. FIG. 4(*a*) is an example of piano roll graphics displayed during rewinding. Conventional display devices for displaying a piano roll are uninteresting, moving the performance position instantaneously to the top of the song when there is an instruction to rewind. However, in certain embodiments of the present invention, scroll display is carried out at high speed in the direction opposite from the direction of scrolling during performance, simulating the appearance of piano roll paper being mechanically re-wound such as a real player piano or the like.

FIG. 4(*b*) shows the top of a song of an example of piano roll graphics, displaying the simulation of the top portion of piano roll paper.

Figure 5:
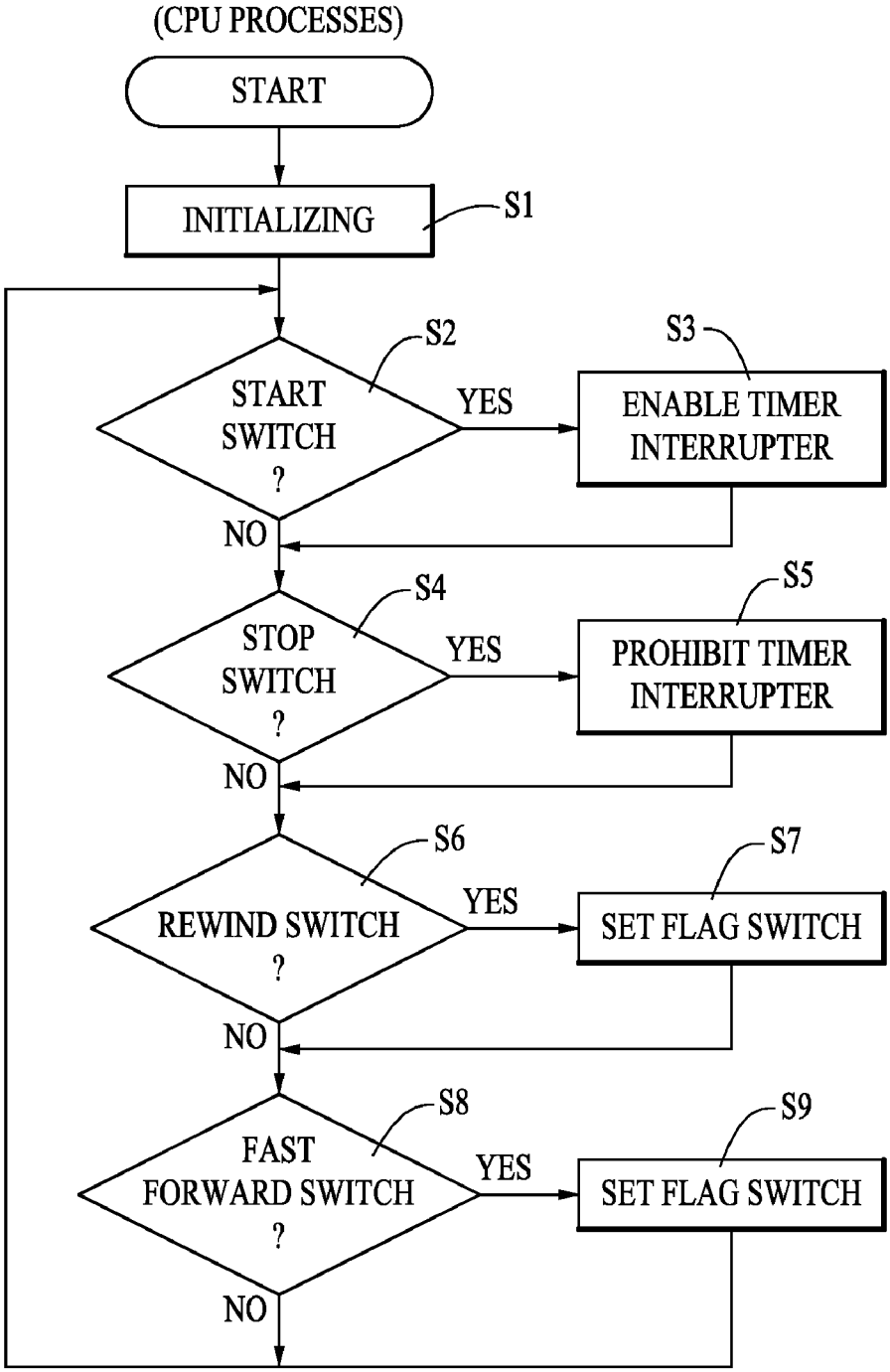
FIG. 5 is a flowchart illustrating a main processes according to an embodiment of the invention.

Next, with reference to FIGS. 5 through 8, an embodiment of piano roll display processing carried out by the CPU 2 executing a control program is described. FIG. 5 is a flowchart illustrating an embodiment of the main routine started when the power of the electronic musical instrument 1 is turned on. The main routine is repeatedly executed until the power of the electronic musical instrument 1 is cut off.

First, the initial settings are made (S1). For the initial settings, a display is formed on the display screen to represent the top of the song shown in FIG. 4(*b*). To simply the description here, the performance information of a plurality of songs will be considered to be already stored in the flash memory 8 and a song already selected. Also, the timer 2*a* is set to time a predetermined time interval (1 millisecond, for example), and a setting is made to disable timer interrupts.

Next, a determination is made as to whether or not the play switch 5*b* has been operated to issue an instruction to start performance (S2). If the play switch 5*b* has been operated (S2:Yes), a setting is made to enable timer interrupts, and a flag stored in the flag memory 4*a* provided in the RAM 4 is set to a value indicating automatic performance (S3).

If the play switch 5*b* has not been operated (S2:No) or the S3 processing has ended, a determination is made as to whether or not the stop switch 5*c* was operated to issue an instruction to stop performance (S4).

If the stop switch 5*c* has been operated (S4: Yes), a setting is made to disable timer interrupts (S5). If an automatic performance is in progress at that time, an instruction is sent to the sound generator 7 to stop the sound production of musical sounds being produced, if a fast forward is in progress, an instruction is sent to the sound generator 7 to stop generation of the fast forward sound effect, and if a rewind is in progress, an instruction is sent to the sound generator 7 to stop generation of the rewind sound effect.

If the stop switch 5*c* has not been operated (S4: No) or if the S5 processing has ended, a determination is made as to whether or not the rewind switch 5*a* has been operated to issue an instruction to rewind (S6). If the rewind switch 5*a* has been operated (S6: Yes), timer interrupts are enabled, a flag indicating rewinding is stored in the flag memory 4*a*, and an instruction is sent to the sound generator 7 to generate a sound for simulating the mechanical sound of starting the rewinding of piano roll paper and later generate a simulation sound of rewinding (S7).

If the rewind switch 5*a* has not been operated (S6:No) or if the S7 processing has ended, a determination is made as to whether or not the fast forward switch 5*d* has been operated to issue an instruction to fast forward (S8). If the fast forward switch 5*d* has been operated (S8:Yes), timer interrupts are enabled, a flag indicating fast forward is stored in the flag memory 4*a*, and an instruction is sent to the sound generator 7 to generate a sound for simulating the mechanical sound of starting the fast forward of piano roll paper and later generate a simulation sound of fast forwarding (S9). If the fast forward switch 5*d* has not been operated (S8:No) or if the S9 processing has not ended, processing returns to S2.

Next, timer interrupt processing is described with reference to FIG. 6. The timer interrupt processing is started up every prescribed time interval (1 msec), and if an automatic performance is in progress, performance data is stacked in FIFO memory, for displaying the operation of the keys of the keyboard, and the automatic performance is processed according to timing delayed behind display processing by DTMAX. If a fast forward or rewind is in progress, the timing is changed. Here, the FIFO first-in, first-out processing may be provided with the RAM 4.

If a key depressing or key release operation is carried out by a performer, and the operation speed is slow, time is required until generation and stopping of the musical sound. Accordingly, a display is provided wherein movement of the key starts before the start or stopping of musical sound according to the key depressing or key release speed. FIG. 6 is a flowchart showing an example of timer interrupt processing.

First, variables and constants in the timer interrupt processing are described, as follows:

wait1 is the wait time for carrying out display (the unit is ticks), the interval from the current time until the next event.

wait2 is the wait time for carrying out control of the sound generator (the unit is ticks), the interval from the current time until the next event.

ptr1 is a pointer for carrying out display, indicating the next automatic performance information to be read.

ptr2 is a pointer for carrying out control of the sound generator, indicating the next read automatic performance information.

DTMAX is the maximum value of the delay time for the display from the start of a key operation until control of the sound generator is carried out (constant).

time is a variable for timing the delay time of the display from the start of a key operation until control of the sound generator.

F is a flag for timing the delay time of the display from the start of a key operation until control of the sound generator only at the initial period of starting a performance. At the start of a performance, F=0, and when the timing of the delay time ends, F=1.

dt is the timer interrupt time interval (the unit is seconds).

tick represents the current time in ticks.

Figures 6, 6A:
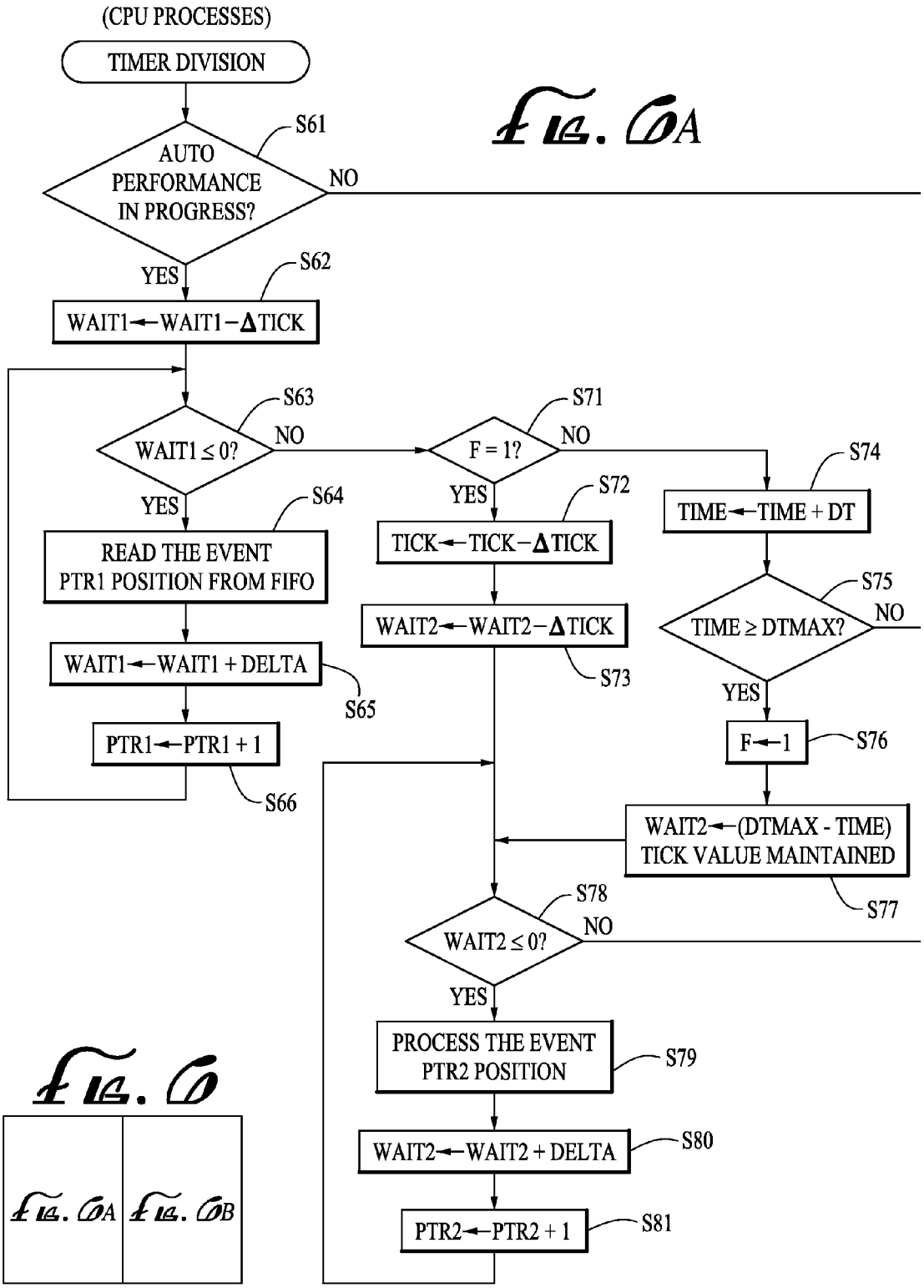
FIG. 6 is a flowchart illustrating a timer interruption process according to an embodiment of the invention.
Figure 6B:
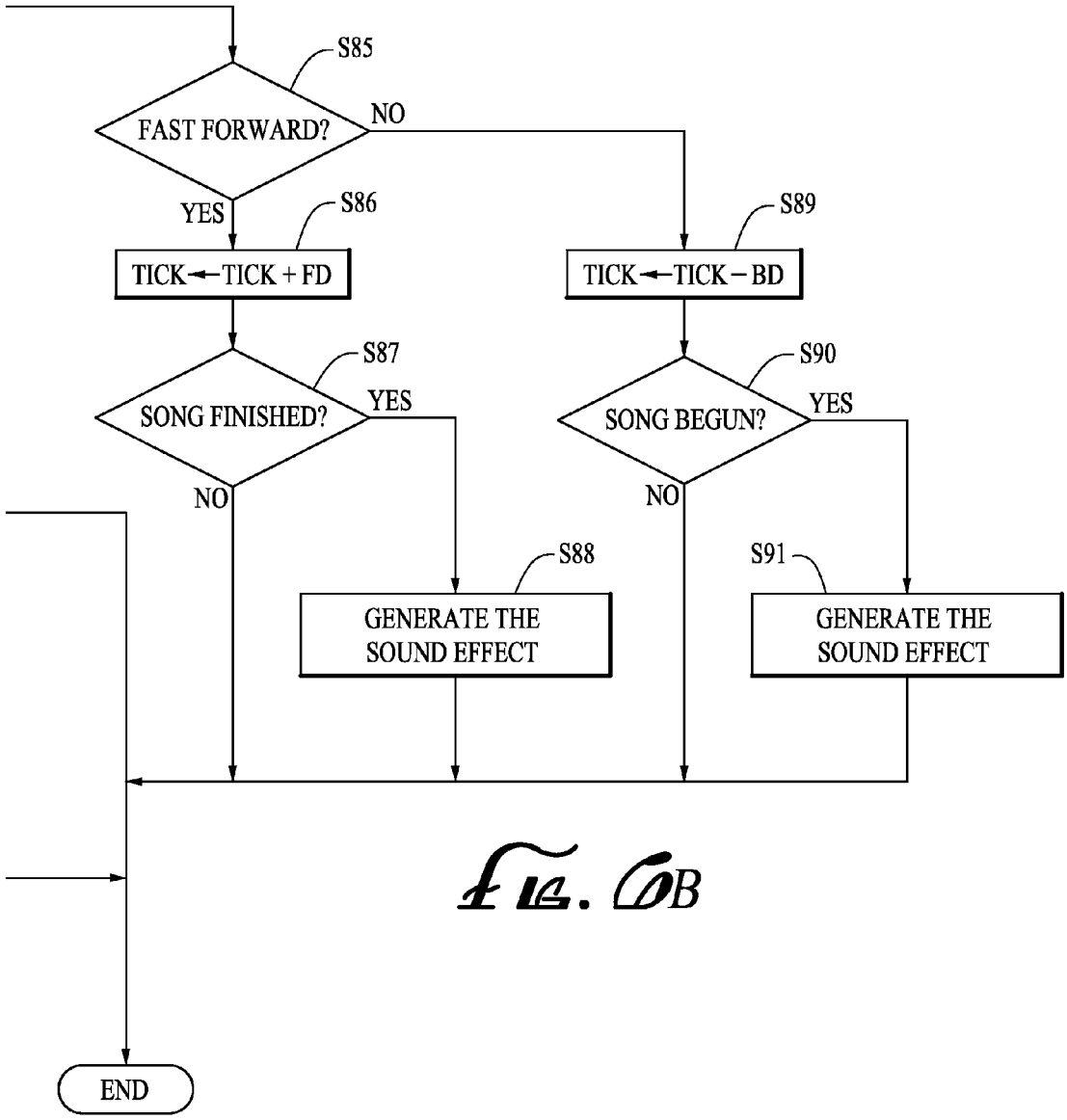

Next, the timer interrupt processing is described according to the flowchart of FIG. 6. First, the flag stored in the flag memory 4*a* is referenced, and a determination is made as to whether or not an automatic performance is currently in progress (S61). If an automatic performance is currently in progress (S61:Yes), the value Δtick for which the time dt is converted to a tick value is subtracted from wait1 (S62).

This Δtick is a tick number corresponding to the time interval dt during which timer interrupts are generated. As described above, when the time interval for timer interrupts is set at 1 msec, a tick is set at the value found by dividing 1 beat by 96, and the tempo value (stored in the tempo value memory 4*b*) is tempo, $$\Delta tick=(tempo\times 96)/(60\times 1000).$$

Next, a determination is made as to whether or not wait1 is 0 or less (S63), and if so (S63: Yes), the event for the performance information indicated by ptr1 is stacked in the FIFO (S64), the stored delta value corresponding to the event indicated by ptr1 is added to wait1 (S65), ptr1 is incremented by 1 (S66), and processing returns to S63.

If it is determined in S63 that wait1 is larger than 0, a determination is made as to whether or not the flag F is 1 (S71). If the flag F is not 1 (S71:No), timing processing of the delay time immediately after a performance start is in progress, the variable time for timing the delay time is incremented by dt (S74), and a determination is made as to whether or not time has reached the delay time DTMAX (S75). If the delay time DTMAX has not yet been reached (S75:No), the interrupt processing ends, and if the delay time DTMAX has been reached (S75:Yes), the flag F is set to 1 (S76), and wait2 is set to a value found by converting the time found by subtracting time from DTMAX to a time with ticks as the unit (S77). The process then proceeds to S78.

If the flag F is 1 in the determination processing of S71 (S71:Yes), then Δtick is added to the value of tick representing the current time in a tick count (S72), and Δtick is subtracted from wait2 (S73).

When the processing of S73 ends or the processing of S77 ends, a determination is made as to whether or not wait2 is 0 or less (S78), and if so (578: Yes), the event at the position indicated by ptr2 is processed (S79). If the event is note on or note off, that message is transmitted to the sound generator 7, and if the event is for changing the tempo, the tempo value is changed. Next, the value of delta stored corresponding to the event indicated by ptr2 is added to the value of wait2 (S80), ptr2 is incremented by 1 (S81), and processing returns to S78.

In the determination processing of S78, if wait2 is larger than 0 (S78:No), the interrupt processing ends.

In the determination processing of S61, if it is determined from the flag stored in the flag memory 4*a* that an automatic performance is not currently in progress (S61:No), a determination is made from that flag as to whether or not fast forward is currently set (S85). If fast forward is currently set (S85:Yes), a value FD is added to the value of tick, incrementing the latter (S86). The value FD is for scrolling the piano roll graphic at high speed when fast forwarding, and is set to the tick number. (96) of one beat or the like, for example.

Next, a determination is made as to whether or not the value of tick has reached the end of the song (S87). If the end of the song has been reached (S87:Yes), the sound effect is changed from that for fast forwarding piano roll paper, the sound effect when fast forwarding of piano roll paper is stopped is generated, and a setting is made to disable timer interrupts (S88). If the end of the song has not been reached (S87:No) or the processing of S88 has ended, the timer interrupt processing ends.

In the determination processing of S85, if it is determined from the flag stored in the flag memory 4*a* that fast forwarding is not currently in progress (S85:No), rewind is currently set, so a value BD is subtracted from the value of tick, decrementing the value of tick (S89). The value BD is for scrolling the piano roll graphic in the reverse direction at high speed when rewinding and is set to the tick number (96) of one beat or the like, for example.

Next, a determination is made as to whether or not the value of tick has reached the beginning (top) of the song (S90). If the beginning of the song has been reached (S90:Yes), the sound effect is changed from that of rewinding piano roll paper, the sound effect when rewinding of piano roll paper is stopped is generated, and a setting is made to disable timer interrupts (S91). If the beginning of the song has not been reached (S90:No) or the processing of S91 has ended, the timer interrupt processing ends.

Figure 7:
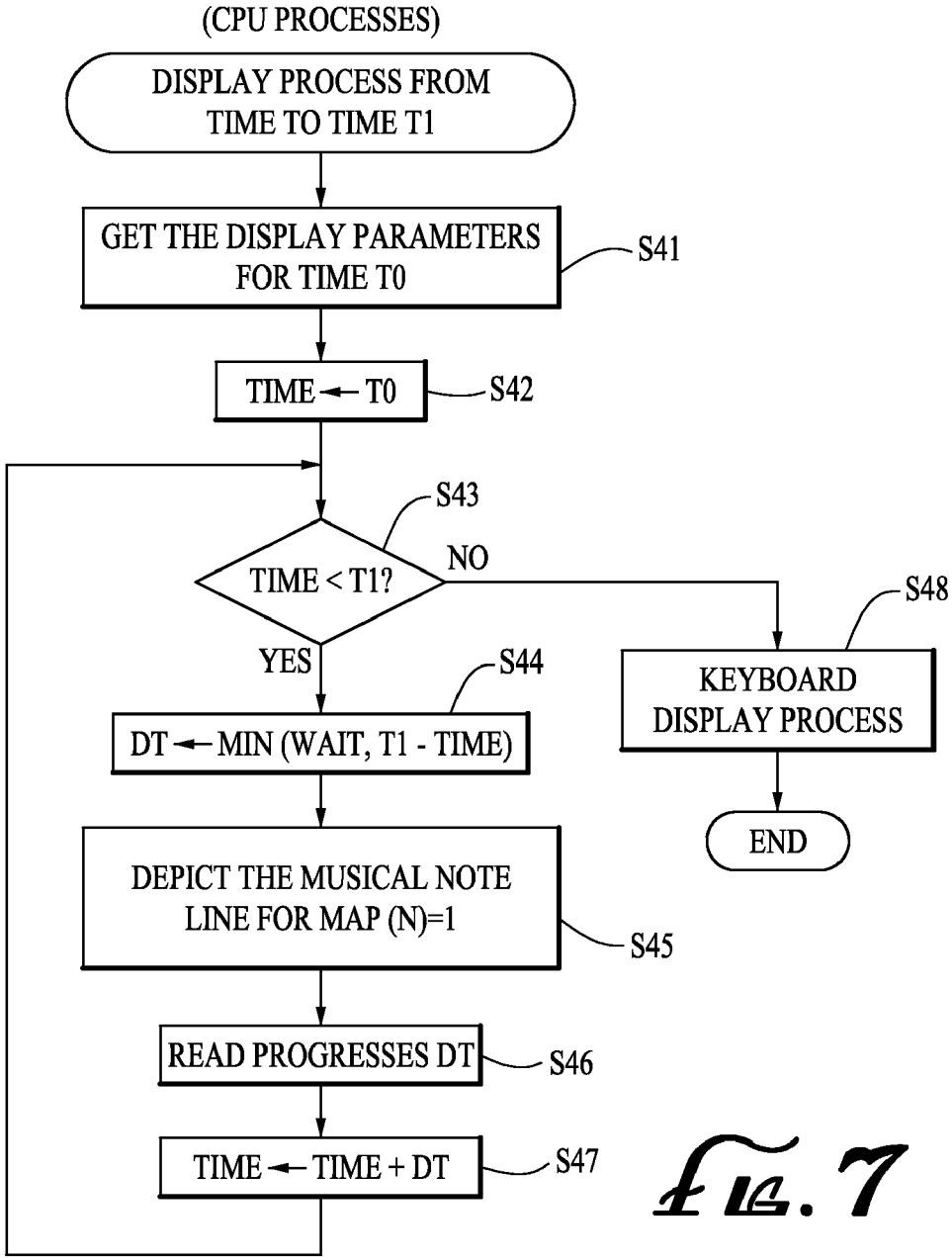
FIG. 7 is a flowchart illustrating a process of depicting a piano roll according to an embodiment of the invention.
Figure 8:
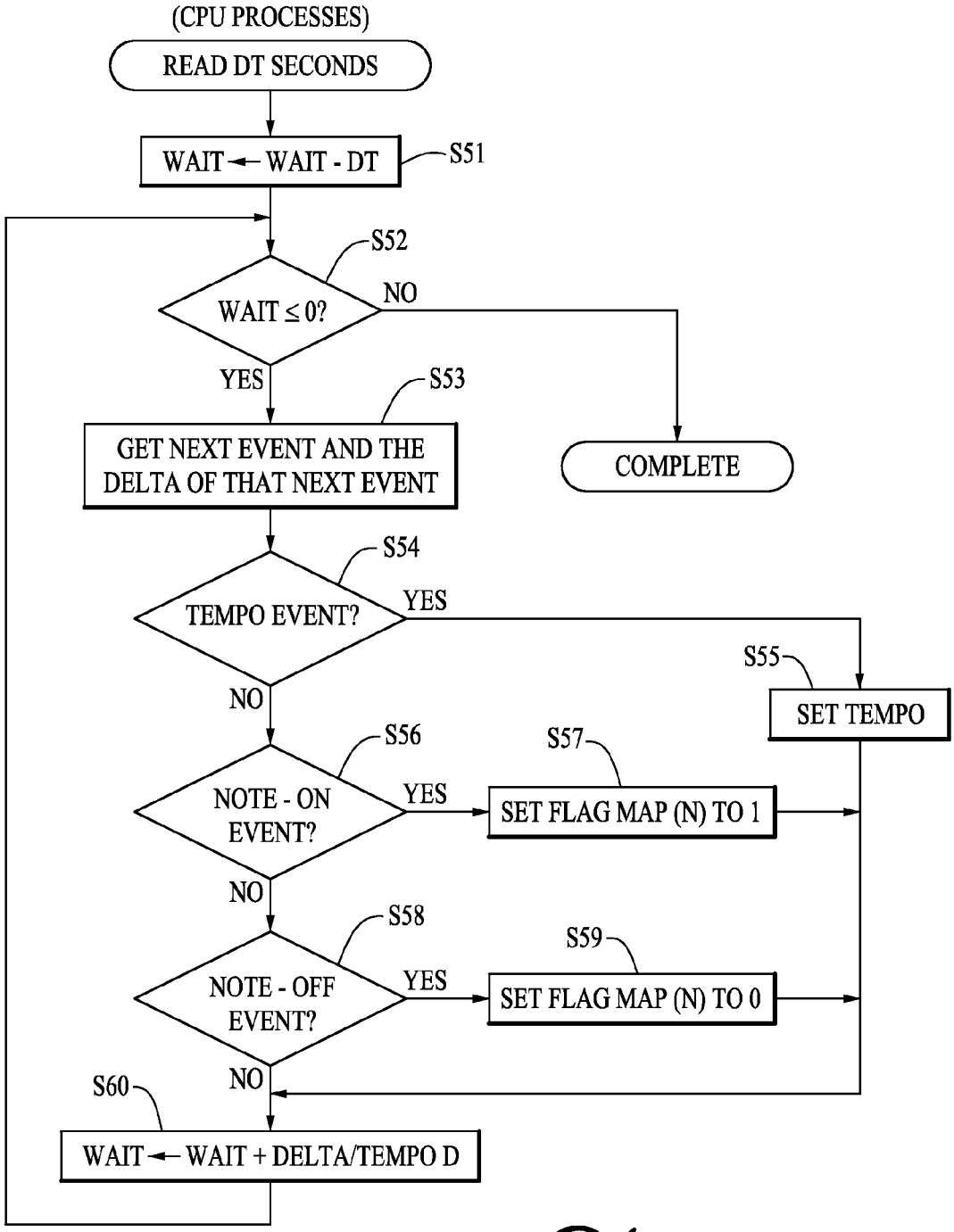
FIG. 8 is a flowchart illustrating read progression processing of the automatic performance information in a process of depicting a piano roll.

Next, with reference to FIGS. 7 and 8, an embodiment of the display process is described. FIG. 7 is a flowchart that shows an example of display processing. In one example, the display processing starts up every 30 msec, and the interrupt processing shown in FIG. 6 starts up every 1 msec, so the interrupt processing starts up 30 times for each display processing.

In the display processing, piano roll display and keyboard display is carried out. The former is first described in detail. The current value of tick is displayed in the vicinity of the center in the vertical direction of the display 6. The displayed range is set to the automatic performance information from time t0 to t1. Here, variables in the display processing are described. These variables are stored in the display parameter memory provided in the RAM 4.

The current time when carrying out depiction is represented by "time", the time from the time time until the next event is "wait", and the note map is represented by map[n], flags for indicating that a key n is depressed. Also, the tempo value referenced when carrying out display is "tempoD", differing from the tempo value stored in the tempo memory 4*b*.

In the depiction processing, the tempo value at time t0 is substituted in tempoD, 1 is substituted in the flag map[n] corresponding to the key in a depressed state, and the value of wait is found (S41). These values are obtained by processing the performance information sequentially from the top of the song, and can be obtained by storing each value at time t0 during the previous display processing and processing the change from that state until the current t0.

Next, time is set to time t0 (S42) and a determination is made as to whether or not time has reached time t1 (S43). If time has reached time t1 (S43:No), depiction of the display screen of the piano roll has ended, so display processing of the keyboard is next carried out (S48), and if the keyboard depiction processing has ended, the depiction processing ends: The depiction processing of the keyboard is described below with reference to FIGS. 10, 11, and 12.

In the determination processing of S43, if time has not reached time t1 (S43:Yes), dt is set to the smaller value of wait and (t1−time) (S44), and the musical note line for the pitch for which map[n] is 1 is depicted (S45). This musical note line is a line segment from the when time is time until it is time+dt for the pitch n.

If there is a measure line in the time dt interval, a horizontal line is depicted at the time of the display screen corresponding to the time of that measure line.

Next, reading progresses of the automatic performance information corresponding to the time dt (S46). This read progression processing is described below with reference to FIG. 8. Next, the current time time is incremented by dt (S47), and processing returns to S43.

Next, reading progression processing of the automatic performance information is described with reference to FIG. 8. FIG. 8 is a flowchart for showing read progression processing of the automatic performance information.

In the read progression processing of the automatic performance information, dt is subtracted from the variable wait (S51). A determination is made as to whether the value of wait is smaller than or equivalent to 0 (S52), and if so (S52:Yes), reading of the automatic performance information progresses, and the next event and delta stored corresponding to that event are obtained (S53).

Next, a determination is made as to whether or not the type of the event indicates a tempo value (S54), and if so (S54: Yes), the value of tempoD is written thereover (S55).

If the type of event does not indicated a tempo value (S54: No), a determination is made as to whether or not the event type is note on (S56), and if so (S56:Yes), the flag map[n] is set to 1 (S57).

If the event type is not note on (S56:No), a determination is made as to whether or not the event type is note off (S58), and if so (S58:Yes), the flag map[n] is set to 0 (S59).

If the event type is not note off (S58:No) or if the processing of S55, S57, or S59 has ended, the value of wait is set to wait+delta/tempoD (S60), and processing returns to S52.

The value of delta is divided here by the tempo value, so the piano roll graphic is displayed with the time axis compressed if the tempo value is large and the time axis expanded if the tempo value is small. Accordingly, the length of a graphic displayed as the piano roll graphic may be displayed shorter for the same musical note length, and conversely, the length of a graphic may be displayed longer when the value of tempo is small.

In the determination processing of S52, if the value of wait is larger than 0, read progression processing of the automatic performance information ends.

Figure 9A:
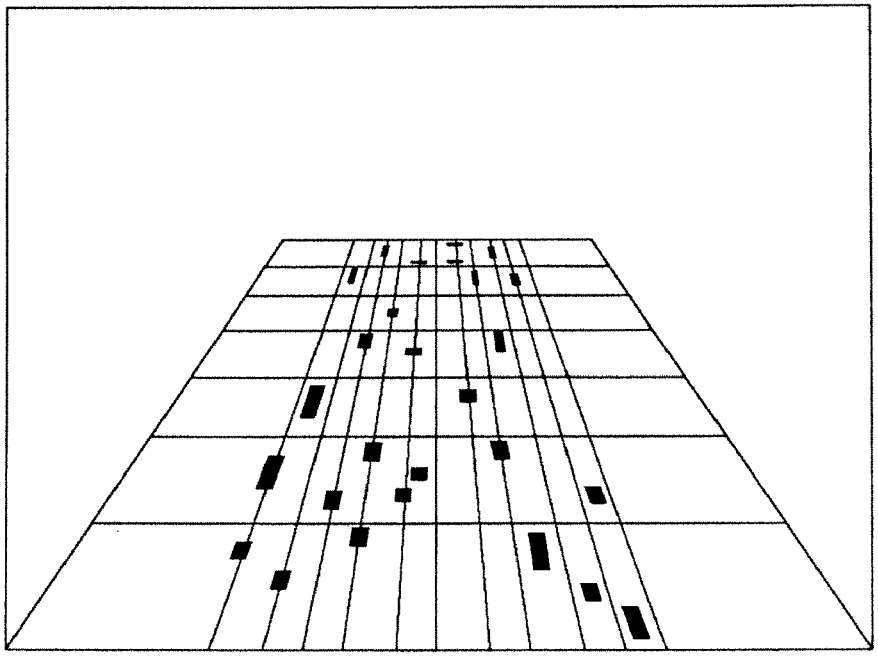
FIG. 9(*a*) and FIG. 9(*b*) are diagrams that displays a further example of piano roll graphics according to an embodiment of the invention.
Figure 9B:
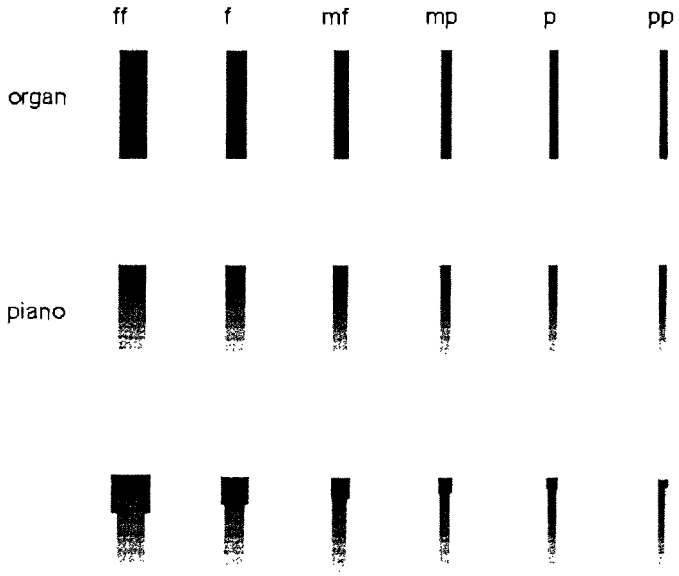

In the embodiment described above, the piano roll graphic is scrolled from bottom to top in accordance with the progress of the performance, but it may also be scrolled conversely from top to bottom or even scrolled sideways. Furthermore, the piano roll paper may be displayed as being conveyed from the front, backward as a three-dimensional display as shown in FIG. 9(*a*).

Furthermore, in the embodiment described above, musical note lines indicating a portion where a key is depressed are line segments with identical thickness, but a display may also be made such that the thickness is varied according to volume, the grayscale is varied according to the volume of the musical sound, or the like. In FIG. 9(*b*), for an organ, the thickness is varied according to volume, and for a piano, display is made in thick black immediately after key depression, growing gradually lighter to simulate the volume growing gradually lower. Furthermore, as shown in the bottommost row of FIG. 9(*b*), the position where a key is depressed may be illustrated with a square, and the degree of depression speed indicated by the size of that square.

Figure 10A:
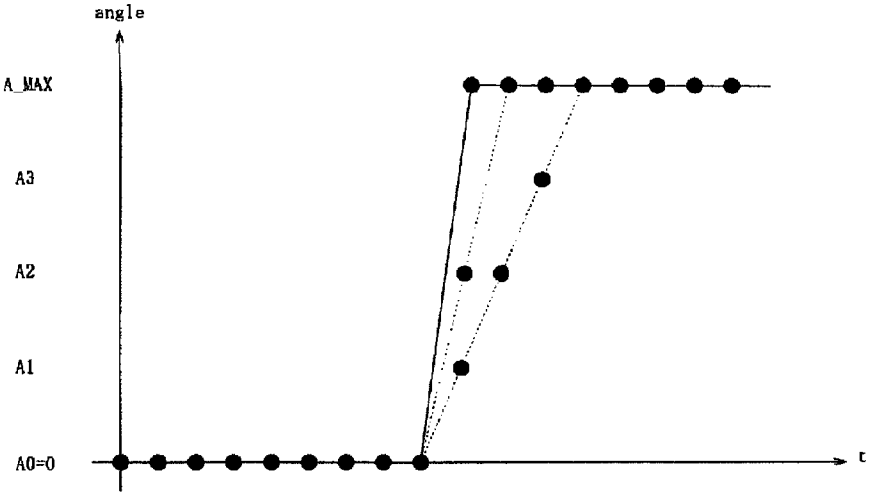
FIG. 10 is a diagram illustrating the outline of the display of keyboard key operations according to an embodiment of the invention, where FIG. 10(*a*) illustrates a graph showing the relationship between the key depression speed and the displayed image and figure, and FIG. 10(*b*) is an example of an image corresponding to the depressed position of a key.
Figure 10B:
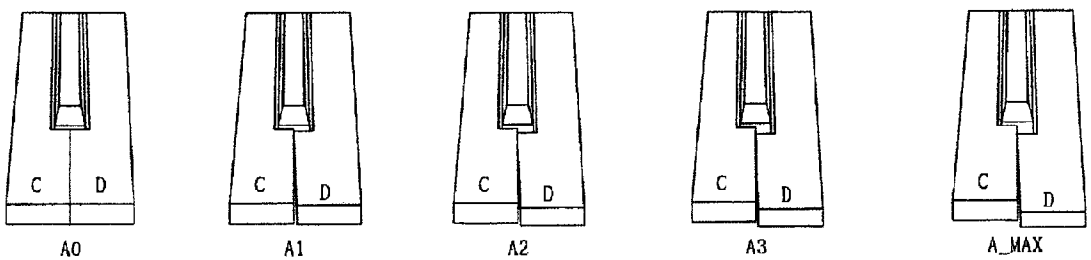
Figure 11:
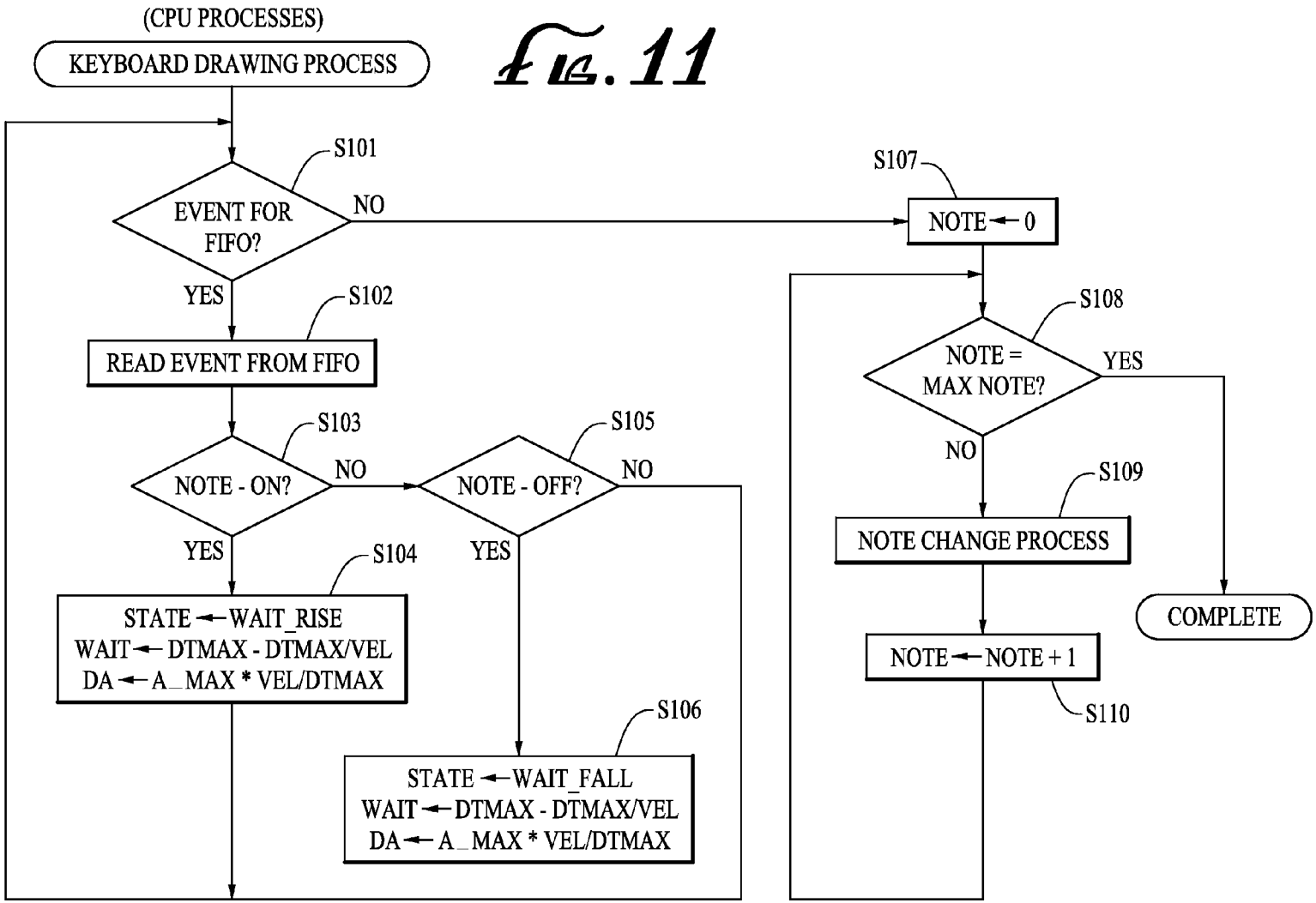
FIG. 11 is a flowchart illustrating a process of depicting a keyboard according to an embodiment of the invention.
Figures 12, 12A:
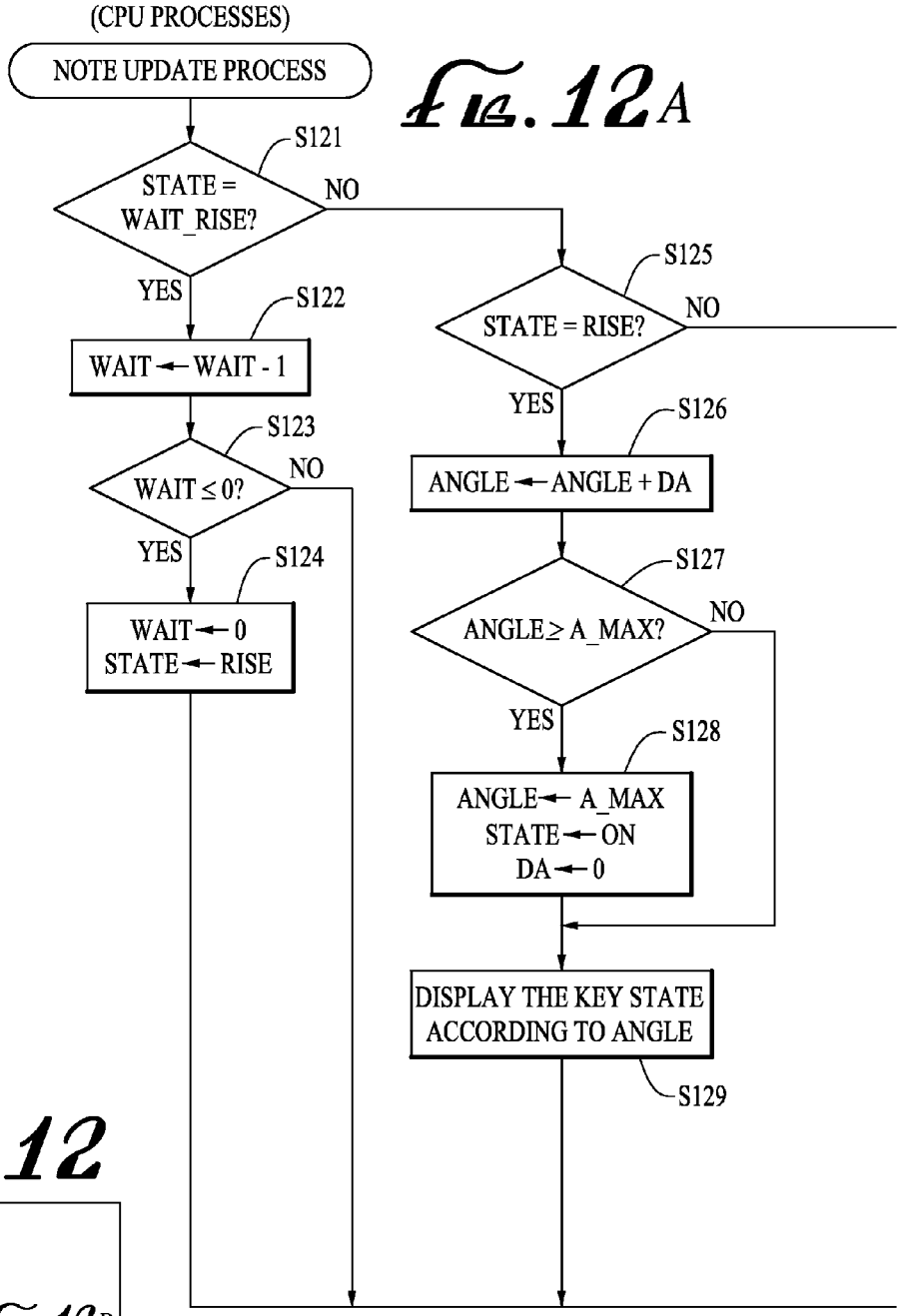
FIG. 12 is a flowchart illustrating a note updating process according to an embodiment of the invention.
Figure 12B:
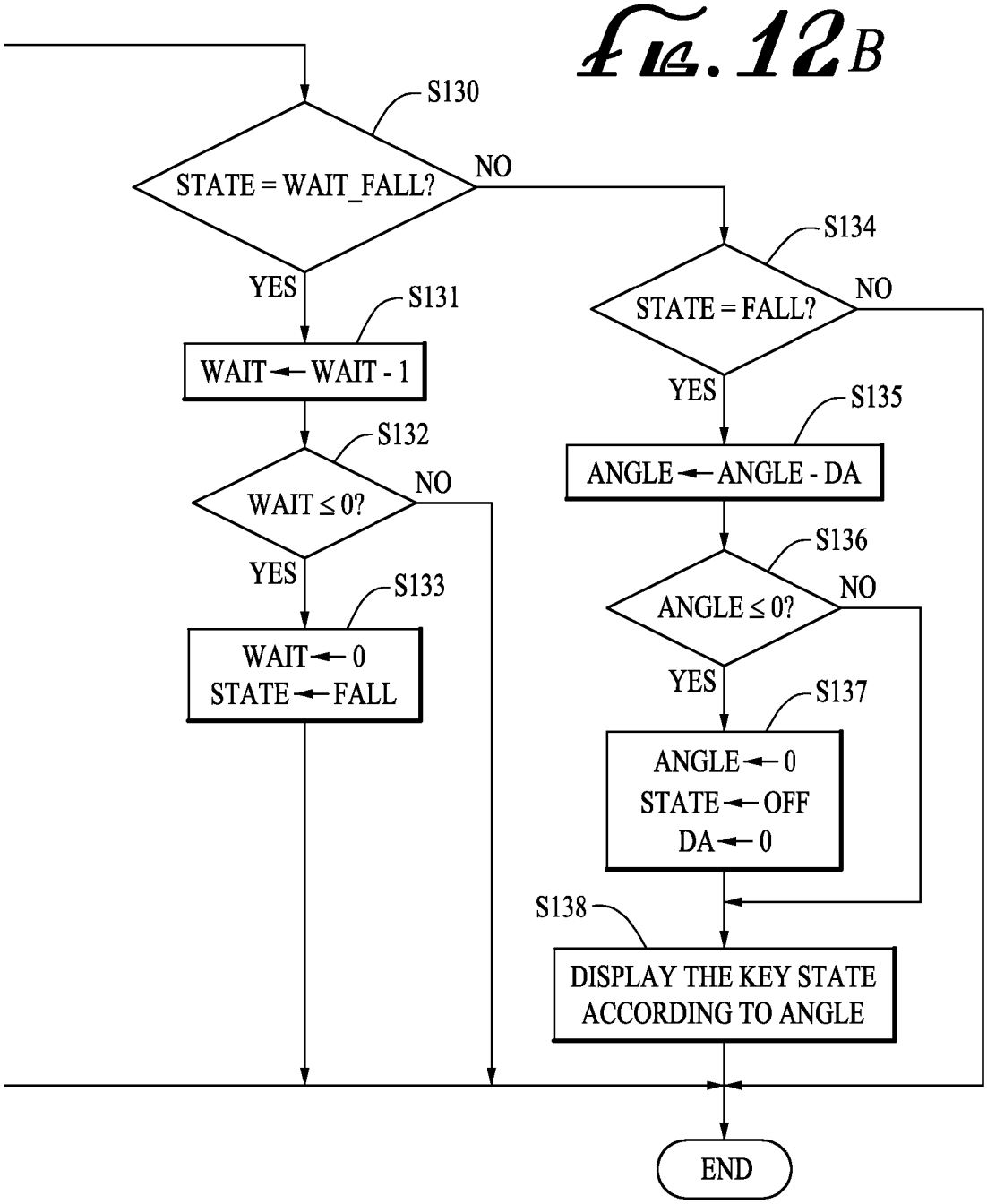

Next, the depiction processing of the keyboard is described with reference to FIGS. 10, 11, and 12. FIG. 10 shows views for explaining an outline of depiction processing, where FIG. 10(*a*) shows processing for switching images according to key depression speed with a graph. In the graph, the horizontal axis is time and the vertical axis is the key position (angle). In general, a key is constructed so as to reciprocate with the axis at the center. In a state of being depressed, the top of the key is maintained flat, and with the angle of the top of the key in this state as a reference (0 degrees: A0), the angle of the key pressing down gradually increases to A1, A2, and A3, reaching a maximum value A_MAX. A solid line in this graph indicates a fast key depression speed, and when displaying a key for a predetermined time interval (30 msec, for example), the state from A0 (released state, topmost position) suddenly changing to A_MAX (bottommost position) is displayed as indicated with the black dots.

When the key depression speed is slightly slower, after the display of the topmost position, display is made of a state of A2, a position nearly in the middle between the topmost position and the bottommost position, and then display of the bottommost position is made. When the key depression speed is even slower, after the display at A0, display at the intermediate position A1 between AO and A2, then display at A2, display at the intermediate position A3 between A2 and A_MAX, and then finally display at A_MAX are made.

FIG. 10(*b*) is an example of a view showing key states; three keys whose notes or pitch names are C, C#, and D are displayed, of which the key whose pitch name is D is shown in states from left to right in the drawing at angles A0, A1, A2, A3, and A_MAX. These images are stored in the ROM3 for each key, and when key depression or release is carried out, an angle is found according to the passage of time, and the image corresponding to that angle is displayed.

Next, the keyboard image processing is described with reference to FIGS. 11 and 12. FIG. 11 is a flowchart that shows an example of keyboard depiction processing, and FIG. 12 is a flowchart that shows an example of note update processing, which is the processing of S109 in the flowchart shown in FIG. 11.

In the keyboard depiction processing, a flag state indicating a state is stored for each key. The state of a released key is OFF, the waiting state for a key to be depressed is WAIT_RISE, the state of a key being depressed is RISE, the state of a key being held at the bottommost position is ON, the waiting state for a key to be released is WAIT_FALL, and the state of a key being released is FALL. wait is a variable for timing the waiting time, note is a number for each key composing the keyboard, vel is the velocity value during depression or releasing, and da is an angle changing per unit time during depression or release; and each takes an integer value. The unit time is the time interval for updating the display (30 milliseconds).

In the keyboard depiction processing, first a determination is made as to whether or not an event is stored in the FIFO (S101). If an event is stored in the FIFO (S1001:Yes), that event is read therefrom (S102), and a determination is made as to whether or not that event is note on (S103). If the event is note on (S103:Yes), the flag state is set to WAIT_RISE, wait is set to the value found by dividing DTMAX by the note on velocity value and subtracting from DTMAX, and da is set to the displacement angle of the key per display time interval according to the velocity value (S104).

The value da is found by the following formula, where the note on velocity value is set to vel:

$$da=A_MAX\times vel/DTMAX$$

where, da is expressed as a value 1 or higher.

In the determination processing of S103, if the event stored in the FIFO is not note on (S103:No), a determination is made as to whether or not that event is note off (S105). If that event is note off (S105:Yes), the flag state is set to WAIT_FALL, wait is set to the value found by dividing DTMAX by the note off velocity value and subtracting from DTMAX, and da is set to the displacement angle of the key per display time interval according to the velocity value (S106).

The value da is found by the following formula, where the note off velocity value is set to vel, similar to during key depression:

$$da=A_MAX\times vel/DTMAX$$

where, it is expressed as a value 1 or higher.

When the processing of S104 or S106 ends, or if in the determination processing of S105, the event stored in the FIFO is not note off(S105:No), the processing returns to S101, and a determination is made as to whether or not any unprocessed events remain in the FIFO.

In the determination processing of S101, if no event is stored in the FIFO, the variable note is set to 0 (S107), and a determination is made as to whether or not the variable note has reached the maximum value (S108). If the variable note has not reached the maximum value, note update processing for the key indicated by note is executed (S109). An example of the note update processing is described below with reference to FIG. 12. When the note update processing ends, the variable note is incremented by 1, and processing returns to S1008. In the determination processing of S108, if the variable note has reached the maximum note, the keyboard depiction processing ends.

Next, the note update processing of S109 is described with reference to FIG. 12. FIG. 12 is a flowchart that shows an example of note update processing. In the note update processing, first a determination is made as to whether or not the flag state indicating the key state is WAIT_RISE (S121). If the state is WAIT_RISE (S121:Yes), the variable wait for showing the waiting time is decremented by 1 (S122).

Next, a determination is made as to whether the value of wait is 0 or less (S123), and if so (S123:Yes), the value of wait is set to 0 and the flag state is changed to RISE (S124). When the processing of S124 ends or if wait is larger than 0 in the determination processing of S123 (S123:No), the note update processing ends.

In the determination processing of S121, if the flag state is not WAIT_RISE (S121:No), a determination is made as to whether or not the flag state is RISE (S125). If the flag state is RISE (S125:Yes), da is added to the variable angle for indicating the key angle (S126).

Next, a determination is made as to whether or not the value of angle is at least the maximum value A_MAX (S127), and if so (S127:Yes), angle is set to A_MAX, state to ON, and da to 0 (S128). After the processing of S128 or if the value of angle is not at least the maximum value A_MAX (S127:No), the processing of S128 is skipped, an update is made to the display of the key state according to the current value of angle (S129), and the note update processing ends.

In the determination processing of S125, if the flag state is not RISE (S125:No), a determination is made as to whether or not the flag state is WAIT_FALL (S130). If the flag state is WAIT_FALL (S130:Yes), the variable wait for indicating the waiting time is decremented by 1 (S131).

Next, a determination is made as to whether the value of wait is 0 or less (S132), and if so(S132:Yes), the value of wait is set to 0, and the flagstate is changed to FALL (S133). When the processing of S133 ends, or if wait is lager than 0 in the determination processing of S132 (S132:No), the note update processing ends.

In the determination processing of S130, if the flag state is not WAIT_FALL (S130:No), a determination is made as to whether or not the flag state is FALL (S134). If the flag state is FALL (S134:Yes), da is subtracted from the variable angle for indicating the key angle (S135).

Next, a determination is made as to whether or not the value of angle is the minimum value 0 or less (S136), and if so (S136:Yes), angle is set to 0, state to OFF, and da to 0 (S137). After the processing of S137, or if the value of angle is not the minimum value 0 or less (S136:No), the processing of S137 is skipped, and an update is made to the display of the key state according to the current value of angle (S138).

When the processing of S138 ends, or if state is not FALL in the determination processing of S134 (S134:No), the note update processing ends.

As described based on the embodiment above, according to the present invention, each key displayed in the keyboard display portion is displayed such as to change at a speed according to the velocity value stored in the automatic performance data, so display may be carried out with a high degree of realism.

In particular, when a musical sound is formed according to the velocity value, the movement of the key displayed in the display, and characteristics such as the volume of the musical sound being generated match, making a display with, a high degree of realism possible.

Furthermore, the time is controlled from when the displayed key starts moving until generation of the musical sound or until the musical sound is silenced according to the depression speed or release speed, so the bottommost position of the key and the generation of the musical sound or the silencing position thereof match, making a display with a high degree of realism possible.

This invention, based the above-described embodiments has been explained above; however, the invention is not limited to the specific embodiments described above. It can be easily inferred that a variety of improved variations are possible within the scope of the present invention.

For example, in the embodiment described above, aspects of the present invention were applied to an electronic musical instrument 1 incorporated in an electronic musical instrument having the keyboard 9 and the like. However, in other embodiments, the piano roll may be displayed in a liquid crystal or other such display device in a personal computer.

Also, in the embodiment described above, automatic performance was carried out based on the automatic performance information and depiction made such that the keys of the keyboard moved based on that automatic performance information. In other embodiments, a performer may perform with a keyboard or the like, where the information indicating the pitch and speed outputted from that performance is inputted, and the key corresponding to the pitch is depicted as moving at a speed according to the speed information.

Also, in the embodiment described above, the keys of the keyboard are displayed in three dimensions, and the keys are displayed as moving at the speed according to the operation speed. In other embodiments, the depressed state and the released state may be displayed with the strength, intensity or change of a color, and the speed of the strength, intensity or color change varied according to the operation speed.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. A display system for an electronic musical instrument, comprising:

an automatic performance information storage device for storing automatic performance information;

a display device for displaying formulated musical notation based on the automatic performance information stored by that automatic performance information storage device;

a performance tempo-setting device for setting performance tempo;

musical note length setting means for setting the length of a graphic corresponding to the length of a musical note displayed on said display device according to the performance tempo set by said performance tempo setting means; and a scroll device adapted to scroll at a set speed regardless of the performance tempo.

2. The display system recited in claim 1, further comprising:

a sound generator adapted to create musical sound; and an automatic performance device adapted to send instructions to the sound generator to create musical sound according to the performance tempo set by said performance tempo setting means.

3. The display system recited in claim 2, wherein the scroll device is adapted to scroll such that a performance location where said automatic performance means is performing is displayed on said display device.

4. The display system recited in claim 1, wherein the display device includes a bar line setting device that displays a bar line.

5. The display system recited in claim 1, further comprising:

display position setting means for arbitrarily setting a display position of a score displayed on said display device;

wherein said scroll device scrolls the display device at a speed faster than said set speed up to a display position of the score set by said display position setting means.

6. The display system recited in claim 1, further comprising sound effect generator for generating a sound effect when said scrolling means scrolls the display device at a speed faster than said set speed.

7. The display system recited in claim 1, wherein said display device displays a graphic corresponding to a musical note based on automatic performance information stored in the automatic performance information storage device and a keyboard comprising a plurality of keys and wherein said display system further comprises:

input means for inputting pitch information for indicating a pitch of a key depressed or released based on said automatic performance information and speed information for indicating an operation speed, and key depiction means for displaying a position of a key according to pitch information inputted by the input means changes at a changing speed according to the speed information.

8. A display system for an electronic musical instrument, comprising:

an automatic performance information storage device for storing automatic performance information;

a display device for displaying formulated musical notation based on the automatic performance information stored b that automatic performance information storage device, the display device comprising:

input means for inputting pitch information for indicating a pitch of a key depressed or released and speed information for indicating an operation speed; and key depiction means for displaying a position of a key corresponding to pitch information inputted by the input means changing at a change speed according to the speed information;

a performance tempo-setting device for setting performance tempo;

musical note length setting means for setting the length of a graphic corresponding to the length of a musical note displayed on said display device according to the performance tempo set by said performance tempo setting means; and a scroll device adapted to scroll at a set speed regardless of the performance tempo key state image storage means for storing an image at the topmost position and an image at the bottommost position of a stroke wherein a key reciprocates as well as an image at a position between the topmost position and the bottommost position;

wherein said key depiction means carries out depiction by switching images stored by said key state image storage means at a time interval according to the speed information.

9. A display system for electronic musical instruments, comprising:

an automatic performance information storage device for storing automatic performance information;

an automatic performance device for issuing an instruction to generate or stop a musical sound based on the automatic performance information stored in the automatic performance information storage device;

a display device for displaying the operations of the keys of the keyboard based on the automatic performance information, the display device comprising:

input means for inputting pitch information for indicating a pitch of a key depressed or released generated by said automatic performance means and speed information for indicating an operation speed, and key depiction means for displaying a position of a key corresponding to pitch information inputted by the input means changing at a change speed according to the speed information; and key state image storage means for storing an image at the topmost position and an image at the bottommost position of a key stroke as well as at least one image of at least one position between the topmost position and the bottommost position;

wherein said key depiction means carries out depiction by switching images stored in said key state image storage means at a time interval according to the speed information.

10. The display system recited in claim 9, wherein said key depiction means depicts a key starting to press down before a timing at which said automatic performance means issues an instruction to a sound source to start sound production.

11. A display system for electronic musical instruments, comprising:

an automatic performance information storage device for storing automatic performance information;

an automatic performance device for issuing an instruction to generate or stop a musical sound based on the automatic performance information stored in the automatic performance information storage device;

a display device for displaying the operations of the keys of the keyboard based on the automatic performance information, the display device comprising:

input means for inputting pitch information for indicating a pitch of a key depressed or released generated by said automatic performance means and speed information for indicating an operation speed; and key depiction means for displaying a position of a key corresponding to pitch information inputted by the input means changing at a change speed according to the speed information;

wherein said key depiction means depicts a key starting to press down before a timing at which said automatic performance means issues an instruction to a sound source to start sound production;

wherein the slower a key depression speed indicated by said speed information, the earlier the timing is set for depicting the key starting to press down.

12. A display program stored on a computer-readable medium for execution by an electronic musical instrument having automatic performance information storage device for storing automatic performance information, and a display device for displaying a graphic corresponding to a musical note based on the automatic performance information stored in the automatic performance information storage device, wherein, said display program is configured to:

set a performance tempo, set a length of a graphic corresponding to the length of a musical note displayed on said display screen according to the performance tempo set by the performance tempo setting step, and scroll said display device at a set speed regardless of the performance tempo.

13. The display program recited in claim 12 wherein said display program is configured to send an instruction to a sound generator to generate a musical sound according to the performance tempo set.

14. The display program according to claim 13, wherein said display program is configured to scroll said display device such that a performance location at which said performance step is performing is displayed on said display screen.

15. The display program according to claim 12, wherein said display program is configured to display a measure line on said display screen.

16. The display program according to claim 12, wherein said display program is configured to arbitrarily set a display position of a score displayed on said display screen; and wherein said scrolling step scrolls the display screen at a speed faster than said set speed up to a display position of the score set by said display position setting step.

17. The display program according to claim 12, wherein said display device is configured to display a graphic corresponding to a musical note based on automatic performance information stored in said automatic performance information storage means and a keyboard comprising a plurality of keys; and wherein said display program is configured to:

input pitch information for indicating a pitch of a key depressed or released based on said automatic performance information and speed information for indicating an operation speed; and display a position of a key corresponding to pitch information inputted by the inputting step changing at a change speed according to the speed information.

18. A display program stored on a computer-readable medium for execution by an electronic musical instrument having a display device for displaying a keyboard comprising a plurality of keys, wherein said display program is configured to:

input pitch information for indicating a pitch of a key depressed or released and speed information for indicating an operation speed, and display a position of a key corresponding to pitch information inputted by the input step changing at a change speed according to the speed information;

wherein said key depicting step carries out depiction by switching the images stored by the key state image storage means for storing an image at the topmost position and an image at the bottommost position of a key stroke as well as at least one image at least one position between the topmost position and the bottommost position at a time interval according to the speed information.

19. A display program stored on a computer-readable medium for execution by an electronic musical instrument having automatic performance information storage means for storing automatic performance information, automatic performance means for generating information for issuing an instruction to generate or stop a musical sound based on the automatic performance information stored in the automatic performance information storage means, and display means for displaying a key of the keyboard moving based on the automatic performance information, wherein said display program is configured to:

input pitch information for indicating a pitch of a key depressed or released generated by said automatic performance means and speed information for indicating an operation speed, and display a position of a key corresponding to pitch information inputted by the input step changing at a change speed according to the speed information;

wherein said key depicting step carries out depiction by switching the images stored by the key state image storage means for storing an image at the topmost position and an image at the bottommost position of a key stroke as well as at least one image at least one position between the topmost position and the bottommost position at a time interval according to the speed information.

20. A display program stored on a computer-readable medium for execution by an electronic musical instrument having automatic performance information storage means for storing automatic performance information, automatic performance means for generating information for issuing an instruction to generate or stop a musical sound based on the automatic performance information stored in the automatic performance information storage means, and display means for displaying a key of the keyboard moving based on the automatic performance information, wherein said display program is configured to:

input pitch information for indicating a pitch of a key depressed or released generated by said automatic performance means and speed information for indicating an operation speed, and display a position of a key corresponding to pitch information inputted by the input step changing at a change speed according to the speed information;

wherein said key depiction step depicts a key starting to press down before a timing at which said automatic performance means issues an instruction to a sound source to start sound production;

wherein the slower the key depression speed indicated by said speed information, the earlier the timing is set for depicting a key starting to press down.

21. The display system recited in claim 1, the scroll device adapted to scroll the graphic at a set speed independent of the performance tempo.

22. The display system recited in claim 1, the scroll device adapted to scroll the same speed for different performance tempos.

23. The display system recited in claim 1, wherein the scroll device is adapted to scroll at a constant speed as the performance tempo changes.

24. The display system recited in claim 23, wherein the musical note length setting means is adapted to change the length of the graphic displayed on the display device as the performance tempo changes.

* * * * *